US007942694B2

(12) United States Patent
Amidon

(10) Patent No.: US 7,942,694 B2
(45) Date of Patent: May 17, 2011

(54) COAXIAL CABLE CONNECTOR SEAL

(75) Inventor: Jeremy Amidon, Marcellus, NY (US)

(73) Assignee: John Mezzalingua Associates, Inc., E. Syracuse, NY (US)

( * ) Notice: Subject to any disclaimer, the term of this patent is extended or adjusted under 35 U.S.C. 154(b) by 0 days.

(21) Appl. No.: 12/496,240

(22) Filed: Jul. 1, 2009

(65) Prior Publication Data

US 2011/0003498 A1 Jan. 6, 2011

(51) Int. Cl.
*H01R 9/05* (2006.01)

(52) U.S. Cl. ..... 439/578; 439/521; 439/279

(58) Field of Classification Search ..... 439/367, 439/369–371, 373, 521, 523, 535–536, 651–652, 439/279, 578
See application file for complete search history.

(56) References Cited

U.S. PATENT DOCUMENTS

| | | | | |
|---|---|---|---|---|
| 1,236,404 | A | | 8/1917 | Clerget |
| 1,921,447 | A | | 8/1933 | Barnett |
| 2,117,029 | A | | 5/1938 | Larsson |
| 3,020,516 | A | | 2/1962 | Despard |
| 5,017,160 | A | | 5/1991 | Garcia |
| 5,397,243 | A | | 3/1995 | MacMurdo, Sr. |
| 5,401,184 | A | * | 3/1995 | Sundstrom et al. ..... 439/367 |
| 5,616,046 | A | | 4/1997 | Sundstrom et al. |
| 6,007,378 | A | | 12/1999 | Oeth |
| 2004/0175983 | A1 | | 9/2004 | Davis |
| 2006/0141846 | A1 | | 6/2006 | Davis |

* cited by examiner

*Primary Examiner* — Khiem Nguyen
(74) *Attorney, Agent, or Firm* — Schmeiser, Olsen & Watts, LLP

(57) ABSTRACT

A connector seal including at least one cylindrical coaxial cable connector, and an elastic sleeve rolled upon itself. The sleeve is configured to unroll to enclose at least a portion of the connector. The portion of the connector may be a connection location between two of the connectors. The portion of the connector may have at least one of differing surface shapes and differing diameters. The elastic sleeve may be fastened to an exterior portion of the connector, may be prepositioned on the connector, and may be configured to be removed entirely from the connector. A release liner covering one side of the elastic sleeve may be rolled up with the elastic sleeve. The release liner may be elastic and may be latex.

20 Claims, 4 Drawing Sheets

COAXIAL CABLE CONNECTOR SEAL

BACKGROUND OF THE INVENTION

This invention relates generally to a seal for coaxial cable connectors, and more specifically, to an external seal for protecting the coaxial cable connector from exposure to environmental elements.

Telecommunication systems have evolved and flourished to provide many telecommunication services, such as cellular and wireless services, and cable television services. Cable television services include, but are not limited to digital television programming, voice over internet protocol (VOIP) services, broadband internet access, and pay-per-view ordering/billing/monitoring. Cellular and wireless services include, but are not limited to services like voice calling, short messaging service, multimedia messaging service, and internet access.

Coaxial cable is used extensively in telecommunication systems to transmit telecommunication signals. In some cases, such as with cable television services, telecommunication signals are delivered to residential or commercial premises by feeder cables running from a head end. Normally, the head end is a facility that houses electronic equipment used to receive and re-transmit video and other signals over a local cable infrastructure. The signals are usually received via satellite, and then redistributed along the feeder cables. The feeder cables extend from the head end and branch off to individual user's facilities along drop cables. These drop cables can be further divided to distribute signals along distribution cables on a user's facility to multiple end devices, such as televisions or modems. Signals are also returned or sent from user facilities in the telecommunication system along the same, but reverse path.

As can be envisioned from the above description, coaxial cable does not run as a single length from a head end to each and every end device. In routing the feeder cables, drop cables, and distribution cables to feed the signals to all the users in a local cable infrastructure, multiple lengths of cable are necessary. Multiple types of cable (e.g. feeder cable, drop cable, distribution cable) can be necessary; and multiple lengths of each type of cable can be necessary. Lengths of cable can be connected to each other by connecting to an intermediate device, such as an amplifier, splitter, or tap. A cable can connect to an end device, such as a television or modem. Often, a length of cable can or must be spliced. When spliced, two connectors join two lengths of the same type of cable, forming a consistent signal path with consistent signal qualities. The signals in coaxial cable are in the form of alternating electrical current, so coaxial cable connectors connecting two lengths of the same cable are designed and used to pass a consistent alternating electrical current without altering the electrical characteristics. Also possible in cable television systems, one length of one type or size of cable can be joined by a connector to another length of another type or size.

Coaxial cables are also used extensively in wireless systems, such as those providing cellular telephone services. In these systems, coaxial cables are used on cellular telephone towers. On each tower, coaxial cables run between antennas at the top and signal devices at the bottom. In these installations, often one length of one type or size of cable is joined by a connector to another length of another type or size. For instance, a large, hard line coaxial cable frequently carries high energy signals the length of a cellular tower. At each end, this hard line coaxial cable connects to a smaller, flexible coaxial cable that can connect to an antenna, or run to a signal device. In this case, the hard, inflexible coaxial cable is necessary to reduce signal loss of the high energy signals, while a smaller, short-length flexible coaxial cable is necessary to run the signal in various directions for convenience of routing.

In order to accommodate the various combinations of connections, including connections between the variously sized cables with various electrical characteristics, a large variety of coaxial cable connectors exist. The diversity of coaxial cable connectors is further increased by innovation over the years attempting to improve signal quality or meet other demands in the telecommunications industry, such as the need for weatherproof connections and connections shielded from undesirable RF noise.

In addition to the variety of coaxial cable connectors, the abundance of their use continues to grow as the telecommunication systems continue to develop and grow. A large percentage of these coaxial cable connectors are used outside, while another percentage of them are used inside a residential, commercial, or industrial property. Many are located underground, connecting underground cables, while some are exposed to the air.

With a growing variety and abundance of coaxial cable connectors in use, damage to coaxial cable connectors becomes a potentially growing problem and cost. Damage can occur to cable connectors both indoors and outdoors, as the cable connectors are exposed to environmental hazards and weathering elements, particularly invading exterior matter. In particular, especially with cable connectors used outdoors, water invading the connector poses a significant threat of damage. Some forms of water include, but are not limited to, rain, condensation, mist, high relative humidity, and flooding. Even indoors, connectors are exposed to water, especially in basements, where they are frequently used. Especially dangerous is water in gaseous form, such as humidity or vapor, which can pervade air space around cable connectors and easily permeate very small openings.

When water gets inside a connector, it can cause significant damage. In particular, water can catalyze corrosion. Corroded parts can negatively affect the electrical characteristics of the cable connector, which can negatively alter signals carried along conductors therein. Water itself, even without corrosion, can negatively affect the electrical characteristics too. A short to ground from the conductor might occur, thereby stopping the signal from reaching its destination altogether.

Damage to coaxial cable connectors can cause significant problems in delivering telecommunication services. These problems can be financially costly as well. Any malfunction or degradation of the connector requires maintenance, as even minor signal alteration can cause major problems. Signal alteration, or loss of desirable signals can cause some form of disruption in the telecommunication services provided to a user. For instance, television images can be distorted, broken, or choppy, while internet can be slowed or lost. Jitter and delay problems with VOIP services can be further aggravated. VOIP services non-sequentially transmit audio as data packets. A delay exists in the transmission of the data packets, and jitter is a variation in delay receiving the data packets that can be caused by physical distance, congestion in the system, etc. Faulty connectors can promote delay or loss of some of these data packets which can disrupt the service or cause poor audio quality.

Furthermore, minor losses in signals returning or sent from user facilities can build up in telecommunication systems to reduce overall signal to noise ratios. To prevent this buildup of signal loss, connectors must be maintained and/or repaired. Maintenance is costly. Diagnosing the problem can be difficult and time consuming. Once identified as a connector issue, connectors must be accessed and repaired, often by digging to expose them, or by accessing them on or in a user's facility. Prolonging the life of connectors by avoiding water damage or damage from other environmental dangers can save time and money, and preserve quality telecommunication services. However, damage is sometimes inevitable, and promoting access to connectors for easier repairing will also help save time and money.

In preventing damage to coaxial cable connectors, particular points of vulnerability that exist on coaxial cable connectors can be protected. These points, such as at joints or unions of two components comprising a single connector, or the union between two different connectors, can be particularly vulnerable to intrusion of external material, such as water, dirt, or other particulate matter. One current attempt to protect connectors includes the use of O-rings at these vulnerable points. O-rings are generally made of some form of plastic or rubber, so they can be compressed between two surfaces to form a seal. When an O-ring is used, it is positioned to establish the seal between two joined parts of a connector, or between two joined connectors. Another solution uses a sleeve positioned over the joint between the two connectors after the connectors are connected.

These solutions have shortcomings. In either case, the seal only protects a limited portion of the connector—mainly a single point of particular vulnerability. Furthermore, during installation of the seal and/or the connector, the seal might be installed incorrectly. Internal seals can be broken or damaged during installation, rendering them ineffective. Separately installed seals, such as seals installed in the field during installation of the connector in a cable television system, can be difficult to install and might be installed imperfectly. The imperfect installation might also result in seal damage.

Also, while there are often particular points of vulnerability, damage to the connector can occur at or from any external point on the connector or at a connection between multiple connectors, where current seals aimed to protect a specific location do not protect. Sometimes it is equally important to protect the entire connector rather than one or more single points. A long sleeve or heat-shrink wrapping can be accommodated to cover various lengths of a connector, or the connection between multiple connectors.

Again however, the use of heat-shrink tubing or a sleeve encounters disadvantages. Once installed, for instance, heat-shrink tubing is not removable and replaceable. A sleeve, too, though less permanent than heat-shrink tubing, would also be difficult to remove and replace. These solutions limit the ability to access coaxial cable connectors to perform maintenance, repair, or other functions requiring access. Additionally, the installation can be difficult or time-consuming, and installers might forget to, or choose not to, install them. Particularly during maintenance, if the seal is removed, and it is not easily reinstalled, the chances are greater the installer will choose not to reinstall it, or will reinstall it incorrectly. The seal might also be damaged in handling.

It would be advantageous to externally seal coaxial cable connectors from exposure to harmful elements without limiting access to the connectors, without leaving vulnerable portions exposed, and without adding disincentive to install the seals.

SUMMARY OF THE INVENTION

In one embodiment of the invention, a flexible sleeve covers at least a portion of an exterior of at least one connector. The sleeve is flexibly configured so it can be easily rolled back to expose the covered areas of the connector(s), allowing easy access to the connector(s). In another embodiment of the invention, the flexible sleeve is elastic, allowing the sleeve to stretch or draw when rolling or unrolling over various diameters on the connector(s) or the connection between multiple connectors.

DETAILED DESCRIPTION OF THE INVENTION

The roll-up sleeve is intended to be used with coaxial cable connectors that attach to an end of a coaxial cable, and connect the coaxial cable to a cable system component or another connector. These connectors can include, but are not limited to "7/16 DIN" connectors, "F" connectors, "C" connectors, "GR" connectors, "BNC" connectors, "IEC 169-2" connectors, and "N" connectors. They are generally cylindrically shaped and carry radio frequency electromagnetic signals in the delivery of telecommunication signals. They attach to the end of the coaxial cable and to compatible connectors by various mechanisms, including, but not limited to crimping, threading, compressing, and snapping. They are shaped with various lengths and diameters. The roll-up sleeve can be embodied so a single sleeve can fit multiple types and sizes of these connectors. Alternatively, the roll-up sleeve can be variously sized to accommodate an even wider variety and array of sizes. One skilled in the art will know the various connectors with which the roll-up sleeve can be used.

Coaxial cable connectors are well known. While one or more connectors are depicted in the FIGS. to illustrate the roll-up sleeve and its use, one skilled in the art will realize the sleeve can be used with a variety of connector types, each with different configurations and sizes. Since, the sleeve is designed and intended to be used with a great variety of connector types and sizes, many individual parts of the connector 10 are not described or illustrated.

Figure 1:
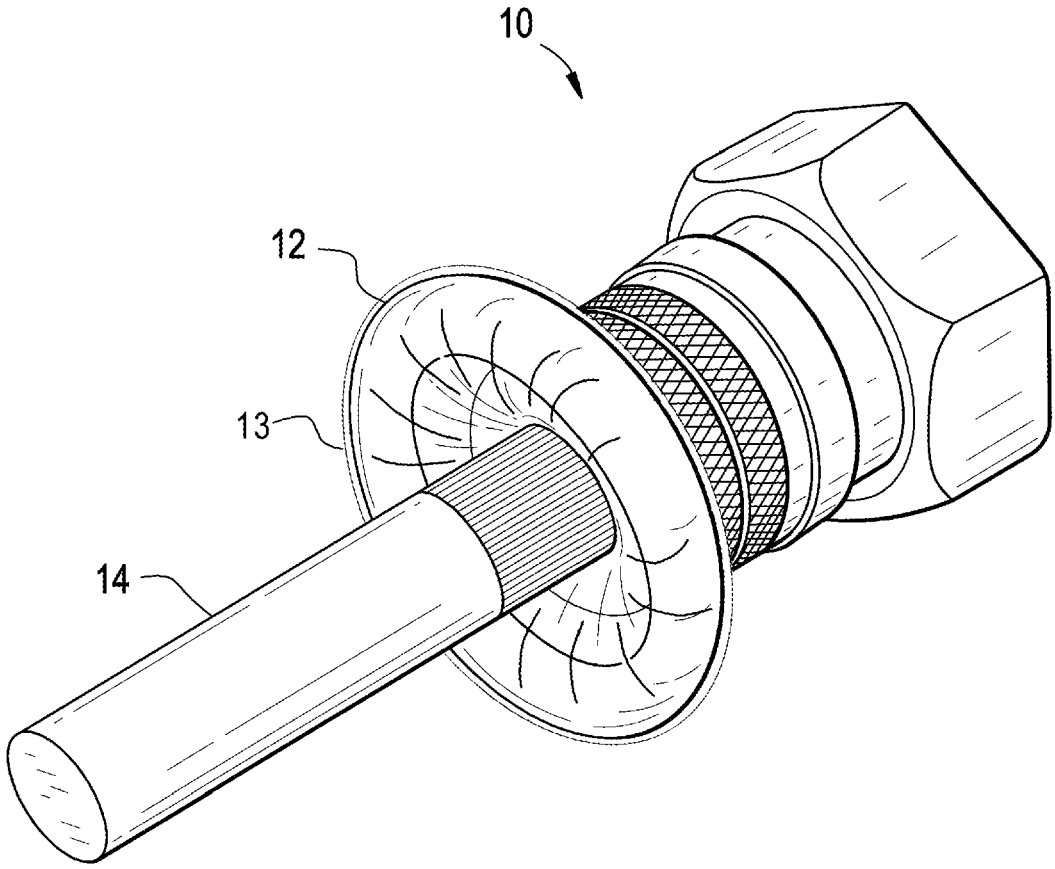
FIG. 1 is an isometric view of the elastic sleeve depicting the sleeve rolled back to expose a connector, according to one embodiment of the invention.

Referring to FIG. 1, a coaxial cable end connector 10 is shown connected to an end of a coaxial cable 14. A roll-up sleeve 12, in a rolled-up state, is positioned around the coaxial cable 14, ready to be unrolled over the end connector 10. The sleeve 12 is flexible, elastic or highly elastic, and generally tubular. In addition to the elastic ability to fit over a single connector 10 of varying diameter and shape, and its connection with a compatible connector, the elasticity enables the sleeve 12 to provide a seal or protection for a large variety of connectors and their connections with compatible connectors. As previously stated, the sleeve 12 can alternately be sized variously in order to enlarge the dimensional range of its use. The sleeve 12 can be made from any suitably flexible, elastic material, including but not limited to, natural or artificial latex, natural or artificial rubber, nylon or other synthetic polymers, polyurethane, and silicone or other adhesive/ self-adhesive materials. In the case of silicon or other similar materials that can self-adhere, a flexible release liner 13 can also be used to prevent self-adhesion while the sleeve 12 is rolled up. Alternatively, a non-removable liner 13 can be used.

Figure 2:
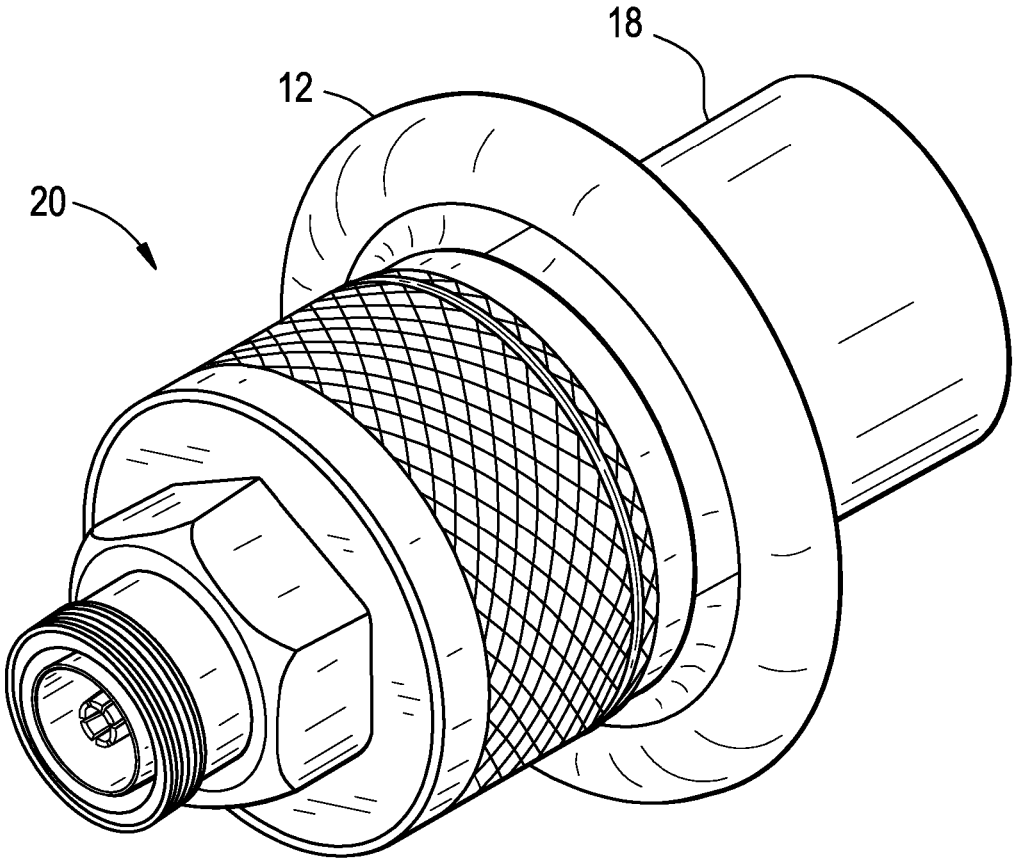
FIG. 2 is an isometric view of the elastic sleeve depicting the sleeve rolled back to expose a connector mate-able with the connector of FIG. 1, according to an alternate embodiment of the invention.

FIG. 2 illustrates the sleeve 12 positioned similarly to the sleeve 12 in FIG. 1, except on a connector 20 that is mateable with connector 10. The sleeve 12 is rolled back to the coaxial cable 18 to expose the connector 20.

Figure 3:
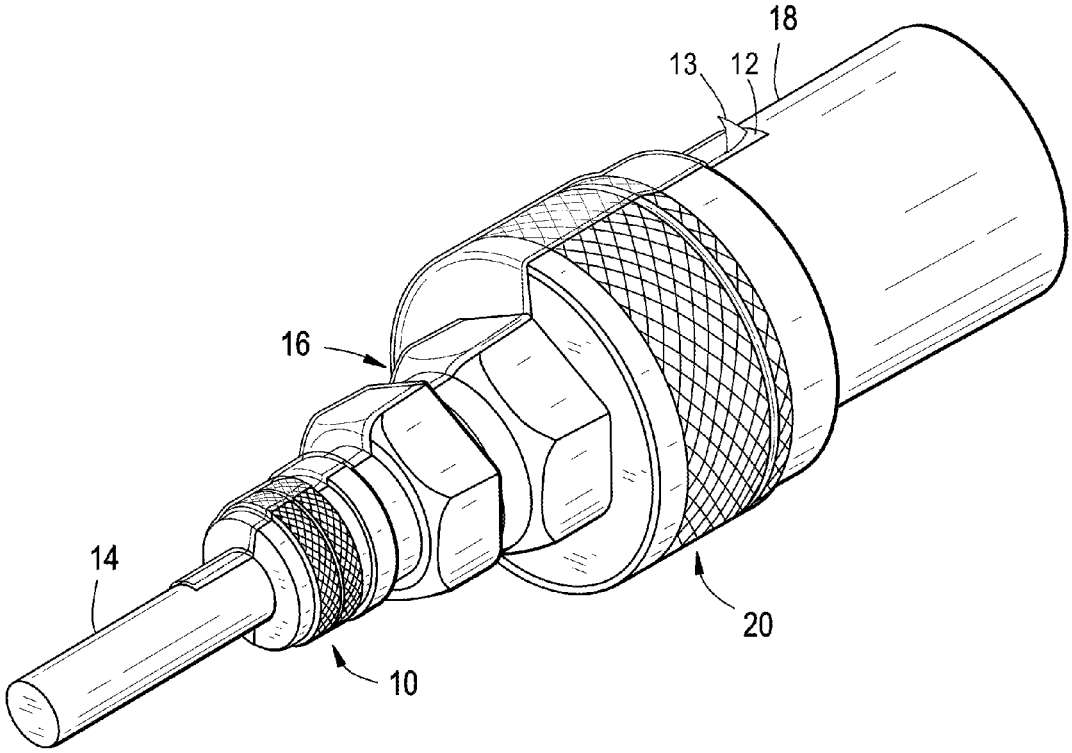
FIG. 3 is an isometric view of the elastic sleeve depicting the sleeve unrolled to cover two mated connectors, according to one embodiment of the invention.

As depicted in FIG. 1, the sleeve 12 can be rolled up and out of the way in order to expose various parts of the connector 10. The sleeve 12, as depicted in FIG. 3, can also be unrolled to cover the connection 16 between the two connectors 10 and 20. One sleeve 12 can be used and rolled to cover the connectors 10 and 20, or two sleeves can be used, and rolled from the cables 14 and 18 toward the connection 16. If more than one sleeve 12 is used, the sleeves can overlap. In the case when the sleeve 12 is made of silicone, overlapping the sleeves can be preferable in order to obtain a fused seal at the overlap. When an adhesive sleeve is used, a liner 13 can be used to prevent the sleeve 12 from adhering while it is rolled up. When the adhesive or self-adhesive sleeve 12 is unrolled, if the liner 13 is a release liner 13, then the liner 13 can be removed.

In the rolled-up state, the connectors 10, 20, or the connection 16 between connectors 10 and 20, can be easily accessed. Making access greater, the sleeve 12 can be removed entirely from the connectors 10, 20 by rolling it off. Rolling the sleeve 12 all the way off the connectors 10, 20 allows, for instance, one or both of the connectors 10, 20 to be replaced on the end of the coaxial cable 14, 18 without also replacing the sleeve 12. When access to the connectors 10, 20, or the connection 16 between them, is no longer needed, the sleeve 12 can be unrolled to cover, or re-cover, and protect the connectors 10, 20, or the connection 16.

Figure 4:
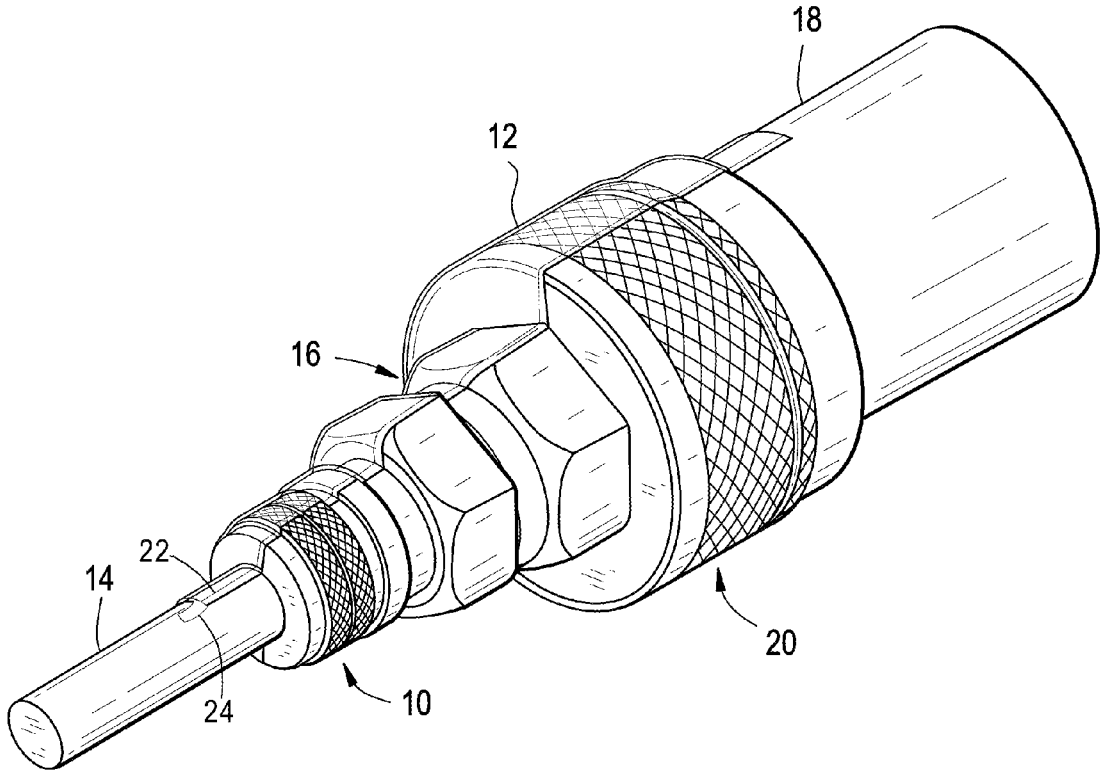
FIG. 4 is an isometric view of the elastic sleeve of FIG. 3 with a tear strip and a pull tab, according to another embodiment of the invention.

Alternatively, the sleeve 12 can be disposably removed entirely by tearing or cutting it off. Referring to FIG. 4, a tear strip 22 can extend through the length of the sleeve 12. It can stick out on one or both ends to create a pull tab 24. Pulling the pull tab 24, in turn, pulls the tear strip 22, which tears through the sleeve 12. The pull tab 24 can also be used separately to lift the edge of the sleeve 12 away from the connector 10, 20 so that the sleeve 12 can be easily cut without cutting the connector 10, 20. In one embodiment, the tear strip 22 does not tear the sleeve 12, but allows the sleeve 12 to be lifted away from the connector 10, 20 along the full length of the sleeve 12, as the sleeve 12 is cut along its full length.

When unrolling the sleeve 12 over one or more connectors 10, 20, the elasticity of the sleeve 12 enables the sleeve 12 to elongate so that the sleeve 12 expands and draws around various parts of the connectors 10, 20 with respectively large and small diameters, or with irregular shapes (i.e. not cylindrical or perfectly cylindrical). The sleeve 12 elongates so that the expansion occurs radially from the center axis of the sleeve 12 and connectors 10, 20. Unnecessary elongation axially might contribute to the sleeve 12 pulling away from the surfaces of the connectors 10, 20 at points where the diameter size transitions, rather than drawing more tightly to the surfaces. Where the sleeve 12 does not draw tightly to the surfaces, the sleeve 12 is more vulnerable to breaking, tearing, or puncture.

The range of diameters that the sleeve 12 can suitably seal depends on the modulus of elasticity, as well as the resting diameter (i.e. the diameter when no force is applied to the sleeve 12). The modulus of elasticity is low (e.g. below 5 MPa), resulting in a high capacity for elongation (e.g. above 750%). The elasticity depends on the material and its thickness. For instance, a latex sleeve with a resting diameter of 1.8 inches (approximately 45.7 mm) and a thickness of between approximately 0.00006 to 0.00012 inches (approximately 0.0015 to 0.0030 mm) might have an elongation about 1,000%, being able to expand around diameters as large as approximately 18 inches (approximately 457 mm). In one example, a polychloroprene sleeve 0.2 mm thick has a modulus of elasticity at 3.0 Mpa, an elongation of 930%, and a tensile strength of 26 Mpa.

Thicknesses can be greater to provide stronger protection or thinner to provide greater elongation. Resting diameters can be larger to provide a greater diameter of expansion or smaller to draw around smaller diameters.

The sleeve 12 protects against natural and artificial hazards, and can draw tightly enough, at least at each end, in order to make a proper seal to prevent foreign substances, such as moisture or water, from intruding. Other potential hazards include, but are not limited to water, ice, electrical shock, air, dirt, and many corrosive chemicals.

The sleeve 12 can be separately attachable to the connectors 10, 20 so that a connector installer can install the sleeve and establish the seal during installation of a connector 10, 20. Alternatively, the sleeve 12 can be pre-attached to the connectors 10, 20 before installation, in order to reduce the risk an installer might forget or otherwise fail to install the sleeve 12 and establish a seal. In this latter case, the sleeve 12 can be pre-fastened or pre-positioned. The sleeve 12 can be pre-fastened at one end of the sleeve 12 to an exterior portion of the connector 10, 20, so that the installer will be able to simply roll out the sleeve 12 over the applicable portion(s) of the connector 10 20, or the connection 16 between connector 10 and connector 20. Alternatively, the sleeve 12 can be rolled at both ends and pre-fastened to the connector 10, 20, somewhere between the sleeve's ends so that the sleeve 12 can be rolled out in two directions. The sleeve 12 is permanently or temporarily fastened by known methods, such as, but not limited to, gluing, welding, or mechanically fastening. It might also be pre-positioned in all the same ways it can be fastened. However, when pre-positioned, the sleeve 12 is placed in position and left unfastened, except by any elastic force of the sleeve 12 around the connector or cable to which is placed.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A connector seal comprising:

at least one cylindrical coaxial cable connector;

an elastic sleeve rolled upon itself, said elastic sleeve configured to unroll to enclose at least a portion of said connector; and a release liner covering one side of said elastic sleeve, said release liner rolled up with said elastic sleeve.

2. The connector seal of claim 1 wherein said portion of said connector is a connection location between two of said connectors.

3. The connector seal of claim 1, wherein said portion of said connector has at least one of differing surface shapes and differing diameters.

4. The connector seal of claim 1, wherein said elastic sleeve is pre-fastened to an exterior portion of said connector.

5. The connector seal of claim 1, wherein said elastic sleeve is pre-positioned on said connector such that it can be unrolled to enclose at least a portion of said connector.

6. The connector seal of claim 1 wherein said elastic sleeve is configured to be removed entirely from said connector.

7. The connector seal of claim 1, wherein said release liner is elastic.

8. The connector seal of claim 7, wherein said release liner is latex.

9. The connector seal of claim 1, wherein said elastic sleeve includes a tear strip.

10. The connector seal of claim 1, wherein said elastic sleeve includes at least one pull tab.

11. A connector seal comprising:

at least one coaxial cable connector;

a flexible sleeve configured to cover at least an exterior portion of said coaxial cable connector, said sleeve further configured to roll back and reveal said exterior portion; and a release liner covering one side of said flexible sleeve.

12. The connector seal of claim 11, wherein said flexible sleeve is further configured to cover a connection location between two of said connectors.

13. The connector seal of claim 11, wherein said flexible sleeve is further configured to be used with differently sized and differently shaped coaxial cable connectors.

14. The connector seal of claim 11, wherein said flexible sleeve is pre-attached to said exterior of said connector.

15. The connector seal of claim 11, wherein said flexible sleeve is pre-positioned on said connector such that it can be unrolled to enclose at least a portion of said connector.

16. The connector seal of claim 11, wherein said flexible sleeve is further configured to be removed entirely from said connector.

17. The connector seal of claim 11, wherein said flexible sleeve includes a tear strip.

18. The connector seal of claim 11, wherein said flexible sleeve includes at least one pull tab.

19. The connector seal of claim 1, wherein said elastic sleeve is self adhering.

20. The connector seal of claim 1, wherein said release liner is at least partially removable from said elastic sleeve.

* * * * *